US009877551B2

(12) United States Patent
Rauch et al.

(10) Patent No.: US 9,877,551 B2
(45) Date of Patent: Jan. 30, 2018

(54) CUSTOMIZABLE JEWELRY NECKLACE

(71) Applicant: Scott H. Rauch, Hewlett, NY (US)

(72) Inventors: Scott H. Rauch, Hewlett, NY (US); David Perullo, Howard Beach, NY (US)

( * ) Notice: Subject to any disclaimer, the term of this patent is extended or adjusted under 35 U.S.C. 154(b) by 0 days.

(21) Appl. No.: 14/797,769

(22) Filed: Jul. 13, 2015

(65) Prior Publication Data

US 2016/0007698 A1 Jan. 14, 2016

Related U.S. Application Data

(60) Provisional application No. 62/024,205, filed on Jul. 14, 2014.

(51) Int. Cl.

| | |
|---|---|
| ***A44C 5/02*** | (2006.01) |
| ***A44C 15/00*** | (2006.01) |
| ***A44C 5/10*** | (2006.01) |
| ***A44C 5/20*** | (2006.01) |
| *A44C 9/00* | (2006.01) |
| *A44C 11/00* | (2006.01) |
| *A44C 13/00* | (2006.01) |

(52) U.S. Cl.

CPC ..... *A44C 15/005* (2013.01); *A44C 5/102* (2013.01); *A44C 5/2009* (2013.01); *A44C 5/2033* (2013.01); *A44C 9/0023* (2013.01); *A44C 9/0046* (2013.01); *A44C 11/00* (2013.01); *A44C 13/00* (2013.01)

(58) Field of Classification Search

CPC . F16B 45/02; A44C 13/00; A44C 5/02; A44C 13/10; A44C 13/102; A44C 15/003; A44C 1/00; A44C 10/00; A44C 5/18; A44C 5/20; A44C 5/2009; A44C 5/10; A44C 5/102; A44C 5/105; A44C 5/107; A44C 5/2066; A44C 11/00; A44C 25/00; Y10T 24/4577; Y10T 24/45325

USPC ..... 59/89, 84, 85; 24/596.1, 592.11; 63/4, 63/15.1, 15.2, 15.3, 21, 38, 33; D11/93

See application file for complete search history.

(56) References Cited

U.S. PATENT DOCUMENTS

| | | | | | |
|---|---|---|---|---|---|
| 1,852,689 | A * | 4/1932 | Baxter | F16B 45/00 | 24/375 |
| 2,425,465 | A * | 8/1947 | Goldblatt | A44C 5/0061 | 59/80 |
| 2,527,090 | A * | 10/1950 | Bauman | G04B 37/14 | 224/152 |
| 2,893,201 | A * | 7/1959 | Jaeger | A44C 11/00 | 59/30 |
| 5,669,241 | A * | 9/1997 | Kohl | A44C 9/0015 | 63/15.1 |
| 7,032,372 | B1 * | 4/2006 | Horvath | F16G 15/12 | 59/78 |
| 8,931,251 | B1 * | 1/2015 | Cipolla | F16G 13/12 | 116/200 |
| 2004/0172972 | A1 * | 9/2004 | Steinberg | A44C 11/00 | 63/38 |

(Continued)

*Primary Examiner* — Emily M Morgan

(74) *Attorney, Agent, or Firm* — Levisohn Berger LLP

(57) ABSTRACT

A necklace comprising links which are capable of allowing additional links to be added to thereby create a customizable necklace, with each of said links comprising an undulating silhouette and structural means to allow adjoining links to be connected together yet preventing adjoining links from rotating with respect to each other to prevent flipping of adjoining links.

2 Claims, 13 Drawing Sheets

(56) References Cited

U.S. PATENT DOCUMENTS

| | | | | |
|---|---|---|---|---|
| 2010/0281918 | A1* | 11/2010 | Colpo ..... | A44C 11/00<br>63/3.1 |
| 2011/0005047 | A1* | 1/2011 | Gangakhedkar ..... | B60P 7/0823<br>24/600.9 |

* cited by examiner

FIG # 1
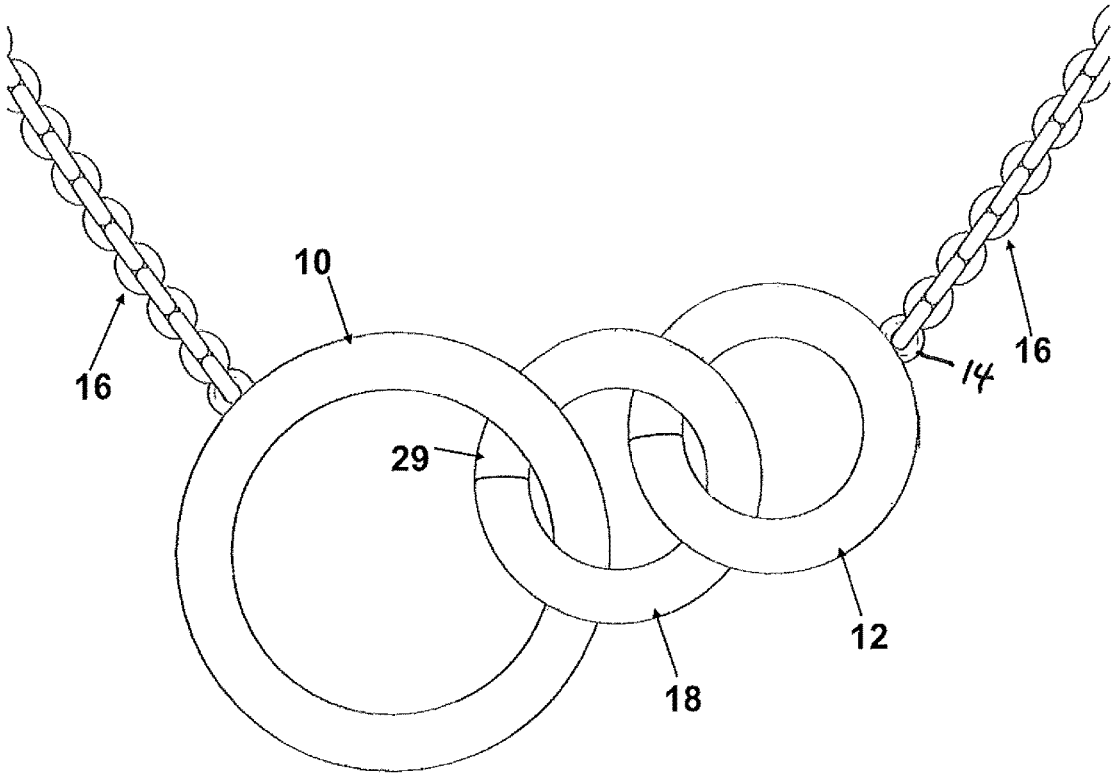

FIG # 2
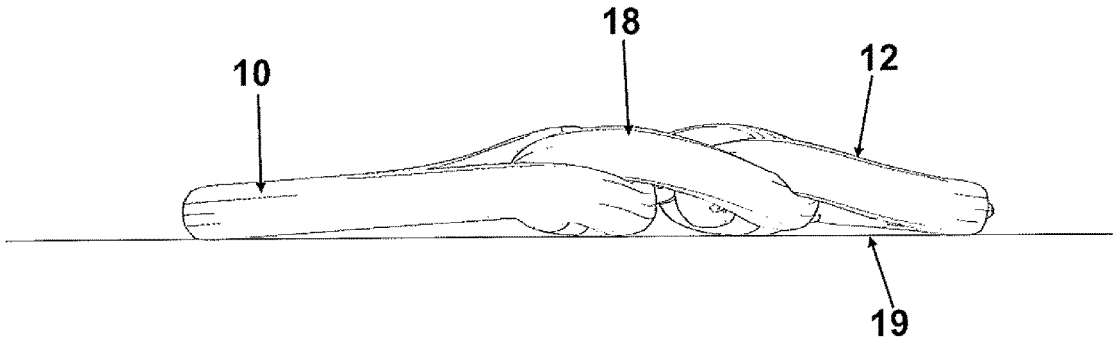

FIG # 3
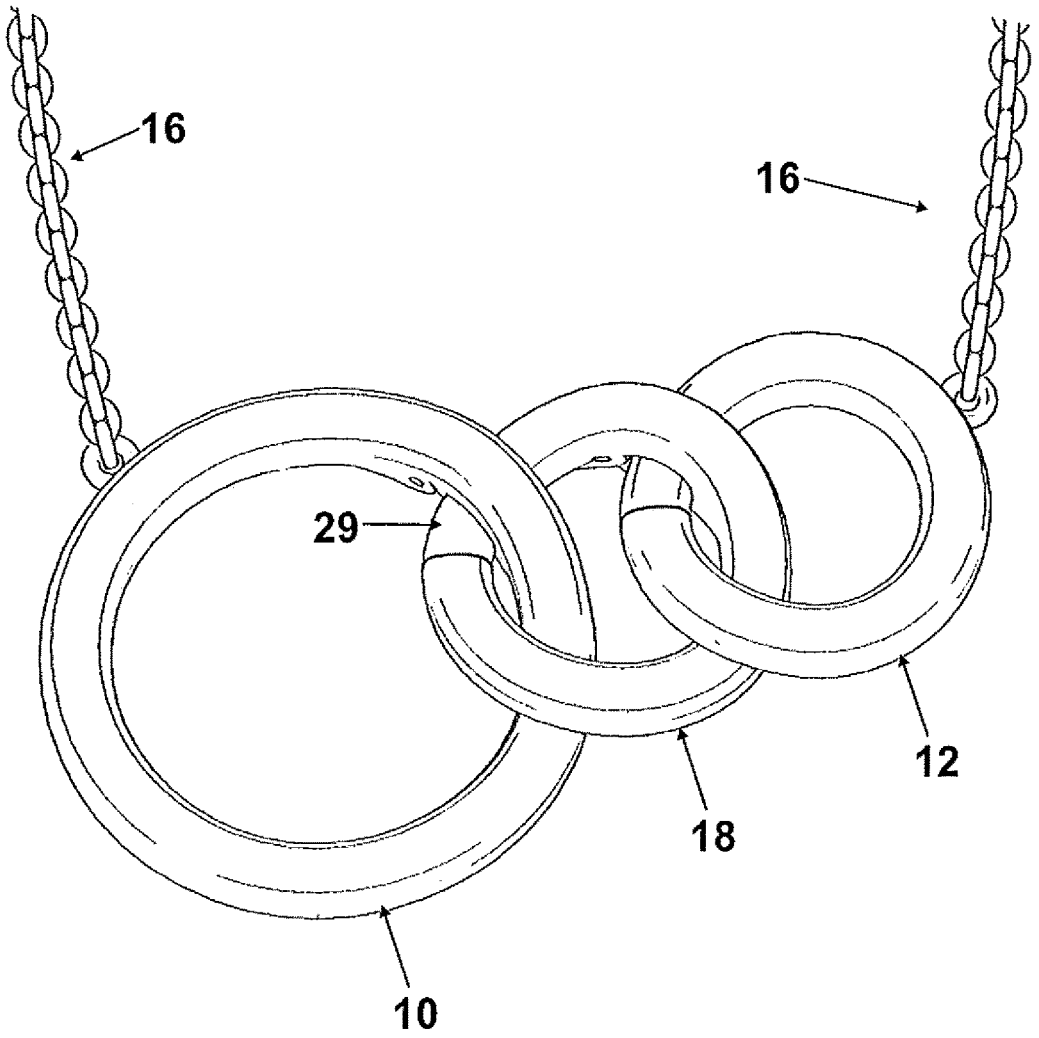

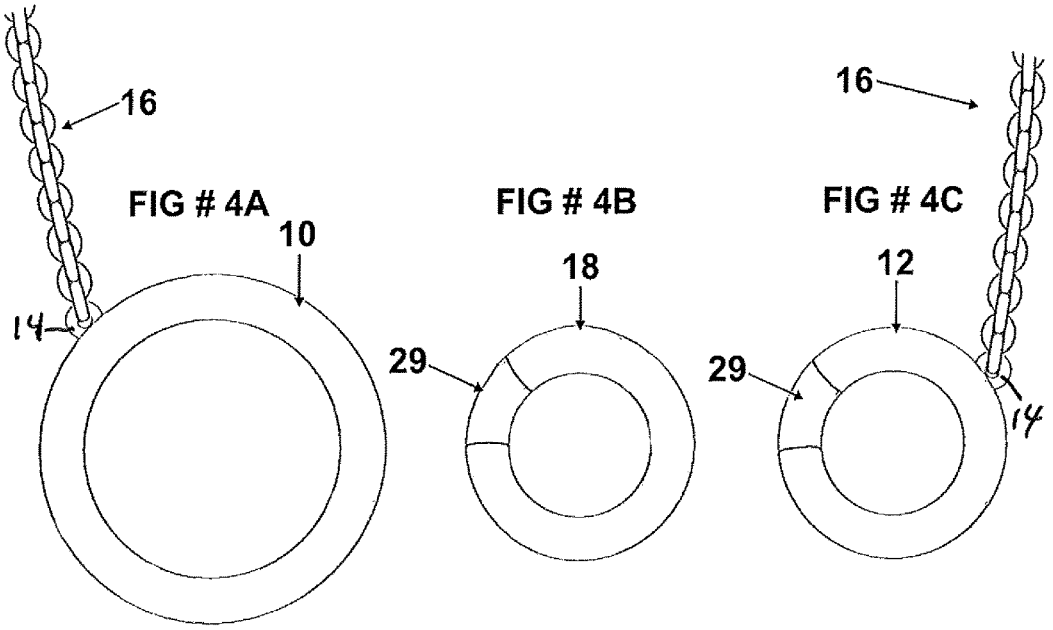
16
FIG # 4A
10
14
FIG # 4B
18
29
16
FIG # 4C
12
29
14

FIG # 5A
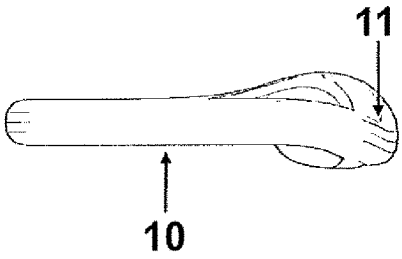
FIG # 5B
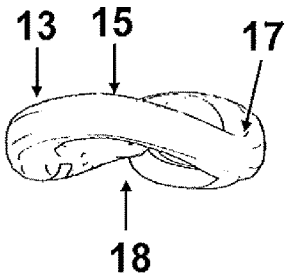
FIG # 5C
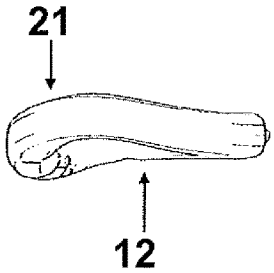

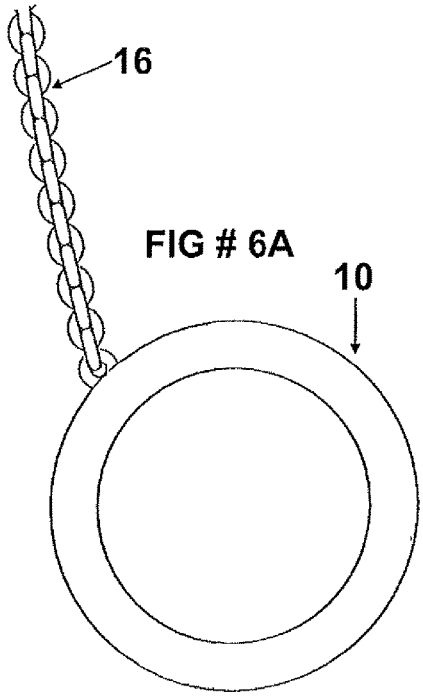
FIG # 6A
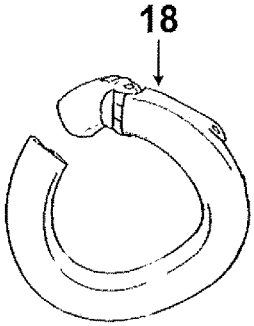
FIG # 6B
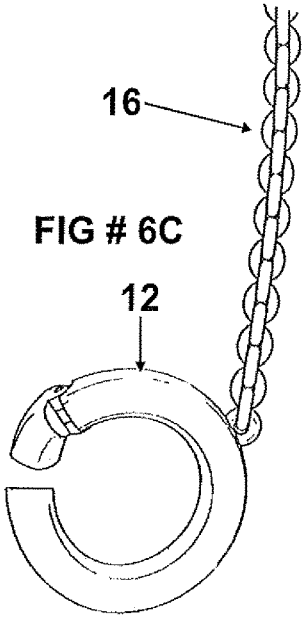
FIG # 6C

FIG # 7A
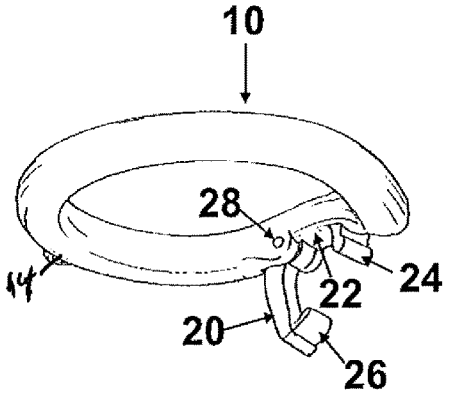
FIG # 7B
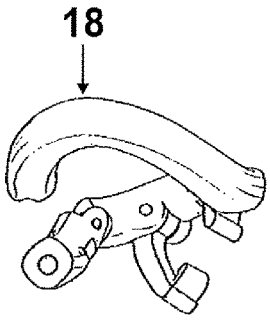
FIG # 7C
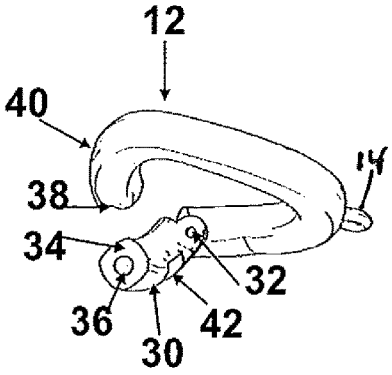

FIG # 8A
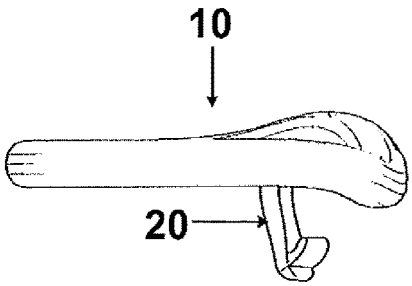
FIG # 8B
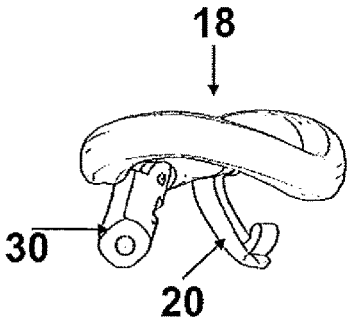
FIG # 8C
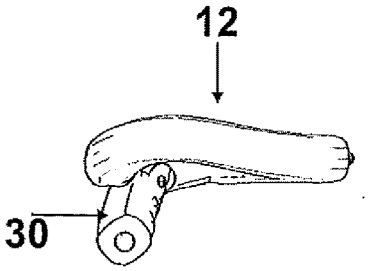

FIG # 9
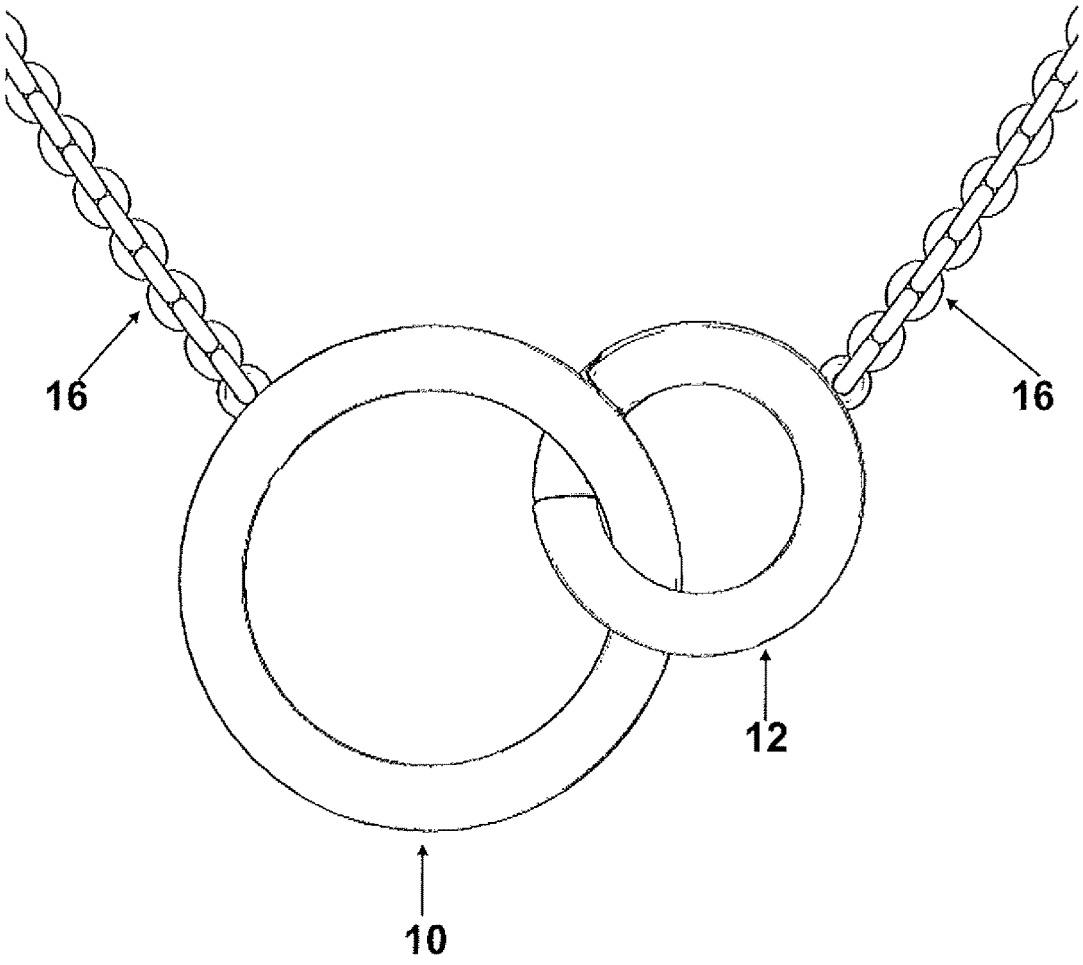

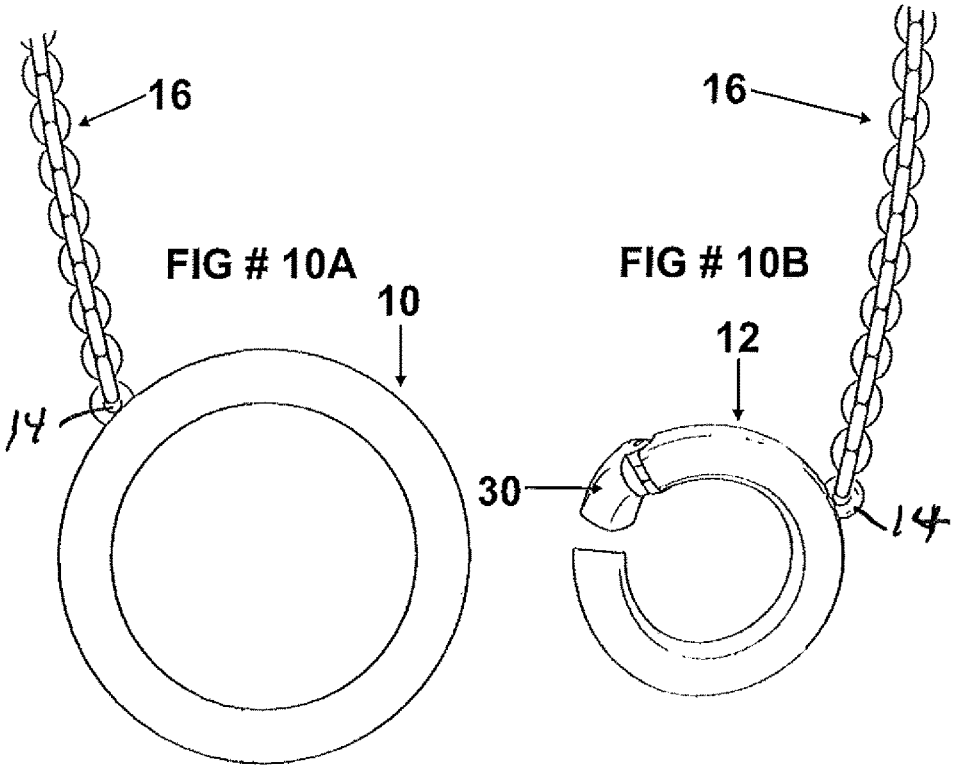
16
16
FIG # 10A
FIG # 10B
10
12
14
30
14

FIG # 11A
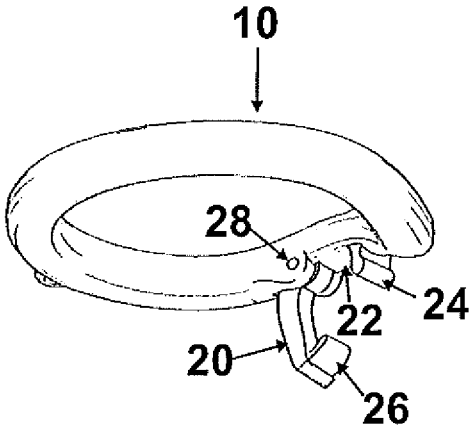
FIG # 11B
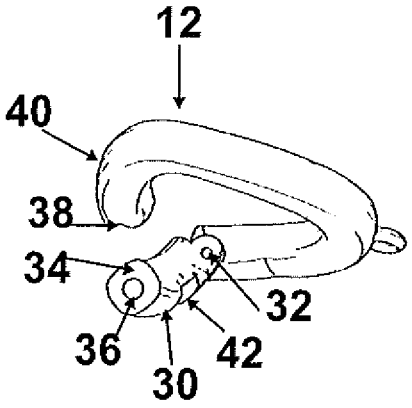

FIG # 12A
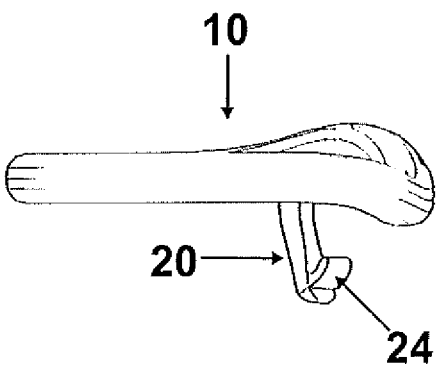
FIG # 12B
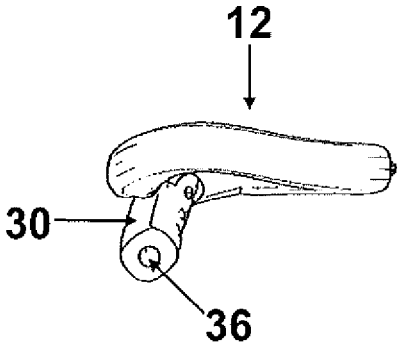

FIG # 13
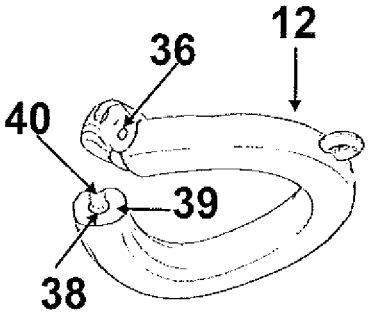

CUSTOMIZABLE JEWELRY NECKLACE

RELATED APPLICATIONS

This application relates to the subject matter of prior provisional patent application Ser. No. 62/024,205, filed Jul. 14, 2014, the contents of which are incorporated herein.

BACKGROUND OF THE INVENTION

This invention relates to a jewelry necklace, with the user having the ability to add or remove links so as to customize the necklace, with the links laying substantially flat on the chest of a woman.

The concept of adding jewelry items for personal experiences and personalized life events, such as the birth of a child, a marriage, etc., has been in existence for quite some time. The present invention is directed to a new and novel structure to enable links to be added to a necklace to commemorate significant events, such as life events, e.g., the birth of a child, by designing such links so that the necklace with the links lies flat on the chest of a woman. The necklace links can be interchangeable with similar links having different designs, and the necklace can be customizable to reflect the wearer's aesthetics.

In the prior art, links, when added are relatively simple, but the structure of such a customizable necklace was such that adjoining links do not lie flat on the wearer, create a relatively uneven and unattractive appearance.

An additional problem of prior structures is that adjoining links may flip with respect to each other which detracts from the desirability, look and appearance of such jewelry.

An object of this invention is to provide a necklace capable of having links added which provides a substantially flat bottom plane.

Another object is to prevent adjoining links from flipping with respect to each other.

Other objects will become apparent hereinafter.

The customizable jewelry necklace of this invention is intended, as briefly stated above, to add links so that life cycle events are commemorated with links being added to or removed from a necklace. For example, a mother-child necklace comprising a large link signifying the mother and a smaller link signifying a first child could be the initial necklace structure. Over time, the mother could add additional links commemorating the addition of children to her family.

The original two link necklace has the two links connected to each other with each link having a bail attached to a chain so that the chain hangs around the neck, and the two interconnected links close the loop. As life cycle events occur, the original links are separated from each other, allowing additional links to be added, thereby customizing the necklace to commemorate such life cycle events.

While this invention is shown with respect to adding rings for purposes commemorating life events, this new jewelry item is independently attractive on its own, and any consumer can choose to personalize her own necklace by adding links as desired to create whatever size the user wishes. To the extent that links may have different ornamental appearances, each of the links remain in position with respect to adjoining links, and the necklace links form a substantially flat rear planar surface allowing the necklace to rest in a fixed substantially flat orientation on the wearer's chest.

In accordance with the teachings of this invention, the necklace has a defined front and back with the links of the necklace formed of an undulating silhouette and each link having a mechanical structure preventing flipping of adjoining links, with the mechanical structure located in the back of the link and the undulating silhouette having space to accommodate such structure so that the front of the necklace has merely an ornamental appearance with the back containing such mechanical structure that not only prevents flipping, it also enables secure addition of links while maintaining a flat rear planar surface which rests on the wearer's chest.

BRIEF DESCRIPTION OF THE DRAWINGS

FIG. 1 is a top perspective view of an embodiment of this invention;

FIG. 2 is a front plan view of the invention of FIG. 1;

FIG. 3 is a perspective view of the invention of FIG. 1;

FIGS. 4A, 4B and 4C are top plan views of each of the individual links of this invention;

FIGS. 5A, 5B and 5C are front plan views of each of the links showing the silhouettes of each link of FIGS. 4A, 4B and 4C, respectively;

FIGS. 6A, 6B and 6C are top plan views of each of the links of FIG. 1 with gate open, allowing addition or removal of links;

FIGS. 7A, 7B and 7C are bottom perspective views of the links 6A, 6B and 6C, respectively, showing the interlocking mechanism of the links;

FIGS. 8A, 8B and 8C are partial perspective front plan views of each of the links 6A, 6B and 6C, as well as 7A, 7B and 7C, respectively, further showing the mechanical interlock between the respective links;

FIG. 9 is a top plan view of just the large and small end links interconnected;

FIGS. 10A, 11A and 12A are views of the larger end link, which views are identical to those of FIGS. 6A, 7A and 8A, respectively;

FIGS. 10B, 11B and 12B are views of the smaller end link, which views are identical to FIGS. 6C, 7C and 8C, respectively; and FIG. 13 is a rear perspective view of a gate structure of a link allowing an adjoining link to be connected.

DETAILED DESCRIPTION OF THE PREFERRED EMBODIMENT

This invention presents several independent aspects or inventions which will be briefly described.

This invention substantially comprises at least two, three or more separate links, with links enabling other substantially identical links to be added, thereby enlarging the necklace. The "mother" link and the "baby" link will be the larger and smaller end links, respectively, with any number of intermediate links.

While the drawings show each of the links to be substantially identical in ornamental appearance, that is merely for illustrative purposes. So long as the intermediate links comprise the structural elements which permit expansion of the necklace in accordance with the teachings of this invention, any such intermediate links are within the teaching of this invention.

While the drawings show the invention as comprising at least larger and smaller end links and an intermediate link, the invention also comprises merely the initial two link necklace, and each of the two links could be of the same size so long as they include the mechanical structure and functions described hereinafter. The number of links can grow from the initial pair to any number as desired by the consumer.

One of the advantages of the present invention, which will be described below, is the ease with which links may be added or removed, and further, the ability to ensure that the necklace lies substantially flat on the chest of the wearer, while adjoining links do not flip one with respect to the other. Such flipping is common in the prior art when links are added to a necklace without mechanical structure to ensure stability for the adjacent links of the necklace when it is worn. Normal wear of such prior art necklaces causes movement of the links of the necklace allowing easy flipping of adjoining links which is unattractive, can be uncomfortable and is generally undesirable.

Referring to FIGS. 1-3, end links 10 and 12 each have a bail 14 which is attached to a chain 16 to be worn around the neck as a necklace in the conventional manner. Initially, and as exemplary, it is intended that larger and a smaller end links are connected to each other, so that there are only two links in the initial necklace as shown in FIG. 9. As time passes and additional intermediate links 18 are added to commemorate life events or for any purpose, links of the necklace are opened, allowing intermediate links 18 to be added thereby creating the customizable jewelry necklace of this invention. All links can be of the same size and identical in shape or can be of different sizes and shapes, including the end links. While FIG. 1 shows chain 16, such chain is understood to be attached to the respective end links in all other figures as well.

FIGS. 2 and 5A, 5B and 5C, as described above, are front perspective views of links of this invention showing the undulating nature of the silhouette of each of the links. The front perspective view is viewing the links from the front edges of each link. This is shown in FIG. 2 with the links 10, 18 and 12 joined together but all resting on the flat rear plane which represents a woman's chest.

The undulating structure of each of the links allows for the links to be interconnected while still creating a substantially flat rear plane 19. By providing structure to maintain each of the links substantially in fixed position with respect to an adjoining link, the undulating nature of each of the links contributes to the substantially flat plane 19 formed at the rear of the necklace, allowing it to be worn without adjoining links flipping and enabling the links to lay substantially flat against the chest of the wearer.

Such orientation of the links, one with respect to the other, is maintained substantially fixed in accordance with the teachings of this invention. Such substantially fixed orientation of adjoining links is independent of the total number of such links because each of the intermediate links contain substantially the same structural elements enabling the undulating links to be connected with respect to each other so as to create a substantially flat rear plane and to substantially lock each of the adjoining elements in substantially fixed position with respect to other adjoining links as seen in FIG. 3.

This invention provides mechanical structures for the links to be opened and closed and further to prevent such links to flip with respect to adjoining links when the necklace is assembled. The undulating silhouette of each link provides space for the mechanical structures which are manually manipulated yet do not interfere with the ornamental appearance of the necklace. This is achieved by locating the mechanical structure on the rear or back of each link so the locking structures are hidden from normal view but is hidden in the undulating structure so that the links form a substantially flat plane on the rear or back, thus enabling the stable link necklace to lie substantially flat on the wearer's chest.

FIGS. 4A-4C, 5A-5C, 6A-6C, 7A-7C and 8A-8C are all arranged so that the A series of each of the Figures represents the large end link 10; the B series shows an intermediate link 18; and the C series shows the small end link 12.

As can be seen in FIGS. 5A-5C, each of the links is undulating, with link 10 having a dip at the right portion of the link as seen in FIG. 5A which is that portion which connects with intermediate link 18. Intermediate link 18 is shown to be undulating from left to right starting low on the left side 13 rising to a higher portion in the front 15, as illustrated in FIG. 5B, and then dropping to a lower point 17 on the right side, which is substantially inverted in the rear portion of the link 18. The mechanical locking structure is located on the rear of links 18 and 12 as at 29.

Link 12 has a rise from left to right starting at 21 of the C Figures, which is the location at which link 12 is connected to link 18 in a substantially fixed fashion because of a locking mechanical structure.

Links 10, 18 and 12, are connected to each other as shown in FIGS. 1-3 are substantially fixed in relationship to each other as will be described hereinafter.

Reference will be made to FIGS. 6A-6C through 8A-8C, illustrating the mechanical structure for locking the interconnected undulating links of this invention.

There are essentially three link elements, the large link 10 nominally being designated the "mother" link and small link 12 nominally being designated the "first baby" link. Each of those links has a different locking mechanism which will be described hereinafter.

Link 10 has a fold-over latch 20 as seen in FIG. 7A hinged at 28 to the back of the body of link 10 with a gate recess area 22 formed in the rear of link 40 below latch 20 when closed. Locking tab 24 fixed to link 10 locks with mating locking latch element 26 when the latch 20 is closed onto tab 24 to hold adjoining link 18 to gate 30 (see FIG. 7C for gate 30 which is the same element on link 18).

For purposes herein and merely for illustration, the embodiment of FIGS. 10A-12A and 10B-12B show only links 10 and 12. FIGS. 10A-12A and 10B-12B are identical to FIGS. 6A-8A and 6C-8C, respectively. The description of the structure of FIGS. 10A-12A and 10B-12B is substantially identical to that of FIGS. 6A-8A and 6C-8C, respectively.

In order to connect end links 10 and 12 (see FIGS. 7A-7C, 11A and 11B), a gate 30 on link 12 is integrally formed as part of the link structure and gate 30 is hinged at one end 32 to the body of link 12. The distal end 34 of gate 30 has a ball projection 36, which projection 36 snap fits into a slot 38 formed at an open face end 39 of link 12 with projection 36 then sliding into and locking in a depression 40, thereby closing link 12. Thus, link 12 has a single hinged gate mechanism which opens and closes the link 12 allowing link 12 to slide onto link 10 and be captured therewith when gate 30 is closed.

When link 12 is connected to link 10 through gate 30, link 12 is substantially locked in place to prevent flipping with respect to link 10 due to the latch 20 structure. Gate 30 of link 12 had a groove 42 recessed in the back of the gate 30 which receives latch 20 which nests therein as latch 20 closes. When gate 30 is closed connecting link 12 to link 10, groove 42 is positioned so that latch 20 fixedly nests in groove 42 thereby substantially locking links 10 and 12 to each other preventing flipping of the respective links.

Link 10 has the fold-over latch mechanism 20 as described and link 12 has gate mechanism 30 as described. The orientation of groove 42 with respect to gate 30 has also been described thereby substantially locking the two links together when both gate 30 is closed and fold-over latch 20 closes as well, thereby connecting and locking links 10 and 12 together.

Intermediate link 18 contains both the gating 30 and latch 20 mechanisms previously described because intermediate link 18 sits between links 10 and 12. The gate mechanism 30 of link 12 is substantially identical to the gate mechanism 30 of intermediate link 18 and the same numerals are utilized because the same functions are provided by the gate 30 of intermediate link 18. Similarly, fold-over latch 20 of link 10 is substantially identical to the fold-over latch mechanism 20 in intermediate link 18, which interlocks with groove 42 of gate 30 of link 12. The fold-over latch 20 and gate 30 of intermediate link 18 are separated from each other on link 18 since gate 30 of link 18 connects link 18 with link 10 while latch 20 of link 18 interconnects with recess 42 of link 12. The structural elements for the gate 30 and latch 20 of link 18 are formed on the rear or back of link 18 enabling a clean ornamental appearance on the front of the link 18 when worn.

When link 12 is connected to link 10 through gate 30 of link 12, link 12 is substantially locked in place with respect to link 10 due to the latch 20 structure of link 10. When gate 30 is closed connecting link 18 to link 12, recess 42 is positioned so that latch 20 nests in slot 42 thereby substantially locking links 18 and 12 to each other.

The concept of adding jewelry items to commemorate life events, as stated above, is well known in the art. On the other hand, the concept of providing undulating links locked together with the locking structure located in the rear of the links so that the bottom plane of the links when assembled is substantially flat, is not known or described in the prior art. Such flat rear plane is accomplished due to the undulating nature of the links providing room for such locking structures to be located within the plane 19.

In particular, one of the problems in the prior art in which links are added to a necklace, is that the links may flip, with respect to adjoining links, producing an unattractive and uncomfortable structure and requiring the wearer to manipulate the necklace links and to fix the displacement of flipped links. In accordance with the teachings of this invention, a flip lock is provided to ensure that one link may not flip with respect to adjoining links.

The novel aspects of the present invention include the undulating silhouette of the links, the interconnection of the links so as to form a substantially rear flat plane for the necklace, the substantial locking of adjoining links to prevent flipping and the provision of intermediate links having both the gate and fold-over latch structures enabling its connection to adjoining links to accomplish the above purposes. Multiple intermediate links may be utilized.

It should be understood that the preferred embodiment was described to provide an illustration of the principles of the invention and its practical application to thereby enable one of ordinary skill in the art to utilize the invention in various embodiments and with various modifications as are suited to the particular use contemplated. Other mechanical structural approaches can be provided to provide both the gate and latching function, and the claims of this invention are intended to cover all such structural approaches as may be apparent to those skilled in the art. All such modifications and variations are within the scope of the invention as determined by the appended claims when interpreted in accordance with the breadth to which they are fairly legally and equitably entitled.

The invention claimed is:

1. A jewelry necklace comprising:

At least two adjoining links, each having a left and a right side, each having a front surface and a back surface, the back surface being non-planar;

A first of the adjoining links has a gap on said left side and a gate sized to fill the gap, the gate is pivoted to the first adjoining link, the gate having an open and a closed position, the open position permits the second of the at least two adjoining links to be connected to the first adjoining link, and in the closed position, the gate is within the gap of the first adjoining link; and A second of the adjoining links has a latch on the right side, the latch pivoted to the back surface of the second adjoining link, the latch having an open position and a closed position forming a space between the latch and the back surface of the second adjoining link, the closed position is capable of receiving the gate of the first adjoining link;

Wherein the gate of the first adjoining link is shaped and sized to non-rotationally fill the space between the latch and back surface of the second adjoining link; and Wherein the first and second adjoining links are non-rotatably connected together when the latch is in its closed position holding the gate of the first adjoining link.

2. A jewelry necklace according to claim 1, further including at least one third adjoining link comprising both said gate and said latch, said at least one third adjoining link is attached between the first and second adjoining links.

* * * * *